United States Patent [19]

Hunkin et al.

[11] 4,155,982

[45] May 22, 1979

[54] IN SITU CARBONATE LEACHING AND RECOVERY OF URANIUM FROM ORE DEPOSITS

[75] Inventors: Geoffrey G. Hunkin, Littleton; Thomas P. Fife; Joseph R. Stano, both of Lakewood, all of Colo.

[73] Assignee: Wyoming Mineral Corporation, Denver, Colo.

[21] Appl. No.: 513,445

[22] Filed: Oct. 9, 1974

[51] Int. Cl.[2] ..... C01G 43/00

[52] U.S. Cl. ..... 423/7; 75/103; 299/4; 299/5; 423/15; 423/17

[58] Field of Search ..... 423/15, 17, 7; 75/103; 299/4, 5

[56] References Cited

U.S. PATENT DOCUMENTS

| | | | |
|---|---|---|---|
| 2,770,520 | 11/1956 | Long et al. | 423/7 X |
| 2,813,003 | 11/1957 | Thunaes et al. | 423/17 |
| 2,896,930 | 7/1959 | Menke | 423/17 X |
| 2,964,380 | 12/1960 | Kolodney et al. | 423/17 |
| 2,982,602 | 5/1961 | Sherk et al. | 423/17 |
| 3,174,821 | 3/1965 | Opratko et al. | 423/17 X |
| 3,239,306 | 3/1966 | Reusser et al. | 423/17 |
| 3,708,206 | 1/1973 | Hard et al. | 299/5 |
| 3,792,903 | 2/1974 | Rhoades | 423/17 X |
| 3,860,289 | 1/1975 | Learmont | 299/4 |

OTHER PUBLICATIONS

Proceedings of the Second United Nations International Conference on The Peaceful Uses of Atomic Energy, vol. 3, "Processing of Raw Materials", pp. 333–339 and 444 (1958), United Nations, Geneva.

*Primary Examiner*—Edward A. Miller
*Attorney, Agent, or Firm*—Z. L. Dermer

[57] ABSTRACT

Uranium ore deposits which contain certain proportions of other metals and elemental components, such as are present in redox roll front ore deposits, are selectively leached in situ by passing therethrough relatively dilute aqueous leach solutions comprising essentially from about 0.5 to 5 grams per liter of ammonium bicarbonate and from about 0.1 to 3 grams per liter of peroxide, preferably introduced as aqueous $H_2O_2$, and sufficient ammonia to bring the solution to a pH of from about 7.4 to 9, and preferably from 7.5 to 8.5, thereafter withdrawing from the ore deposit the aqueous leach solution enriched in uranium which it preferentially extracts along with a generally lower proportion of other metals and elements as compared to their respective ratios in the ore deposit, and contacting the enriched leach solution with a strong base anion exchange material to strip the uranium from the leach solution. The uranium is eluted by treating the base anion exchange material with an aqueous eluant, and finally the uranium is recovered from the uraniferous eluate by first acidifying it and then treating with ammonia to produce a precipitate of relatively pure ammonium diuranate. The stripped leach solution is separated from the base anion exchange material and the stripped leach solution is recirculated through the ore deposit after adjusting it with more ammonium bicarbonate, peroxide and ammonia. After the uranium in the ore deposit is removed to the extent economically practicable, the leach solution is replaced with an aqueous reducing solution which is passed into the ore deposit in order to precipitate and render insoluble any uranium and elements such as vanadium, molybdenum and selenium. The process produces above ground a very low volume of impurities and waste solutions requiring disposal, and causes no significant or material contamination or deterioration of the underground deposits or any aquifer associated therewith.

14 Claims, 4 Drawing Figures

IN SITU CARBONATE LEACHING AND RECOVERY OF URANIUM FROM ORE DEPOSITS

BACKGROUND OF THE INVENTION

This invention relates to the recovery of uranium from underground ore deposits or bodies by in situ leaching and the subsequent processing of the enriched leaching solution to recover relatively pure uranium compounds therefrom.

1. Prior Art

Efforts have been made in the past to recover mineral values from underground ore deposits by introducing various leaching solutions in order to avoid the costs and problems of mining, such as are involved in tunneling, blasting and hauling of ore to the surface and then processing the ore by various means as by grinding, ball milling and flotation, followed by chemical solution or pyrometallurgy to recover the desired minerals therefrom. The application of leaching solutions of various types to underground ore deposits has been attempted with results that have varied widely, and only a few have been particularly successful, as for example, in the recovery of sulfur and salt. One of the problems leading to a lack of success for leaching out other minerals has been the fact that such other mineral whose recovery by in situ leaching is desired in that they often comprise only a small proportion of the total volume of the soluble minerals and insoluble gangue in the underground ore body. Consequently, the leach solutions must penetrate deeply into masses of gangue for a small recovery of the desired mineral values. In addition, the leaching solutions quite often have reacted with or been contaminated by numerous other minerals than the ones particularly desired as well as by clays and salts. This arises because the contaminants have also been only too well dissolved by the leaching solution. Leach solutions so contaminated have necessitated mush subsequent refining processing in order to separate effectively the desired mineral from the undesired materials. A third factor is that excessive amounts of expensive leaching materials are necessarily employed because large proportions thereof are either dissipated, as by reaction of leach acids with limestone or calcite, or else substantial volumes of the expensive leaching solutions escape or are trapped and lost in the crevices of the ore deposit and never recovered.

These problems of in situ leaching are particularly critical in the process of recovery of uranium which is present in small percentages in most ore deposits that are reasonably amenable to leaching in situ.

U.S. Pat. No. 2,738,253 issued Mar. 13, 1956, discloses an initial application of an aqueous solution of sodium chlorate to a uranium bearing ore body followed by an acid leaching solution, which latter may or may not have additional sodium chlorate present therein, in order to recover the uranium values. The inventors in this patent indicate the fact that these ore bodies are often associated with ferrous iron along with tetravalent uranium. Tetravalent uranium is relatively insoluble in the leaching solution. By employing the sodium chlorate, the patent teaches that oxidation of the ferrous iron to ferric iron and the tetravalent uranium to hexavalent uranium is accomplished so that the acid leaching solution will readily dissolve the uranium and render it available.

Other acid leaching solutions are known, as in U.S. Pat. No. 3,309,141 issued Mar. 14, 1967, which discloses the combination of sulfuric acid and sodium chlorate in a leaching solution for extracting uranium from uranium bearing ore. U.S. Pat. No. 3,309,140 issued Mar. 14, 1967 teaches the use of a leaching solution comprising from 5 to 25 grams per liter of nitric acid and from 0.5 to 2 grams per liter of sodium chlorate. It is taught that the sodium chlorate is employed in order to oxidize the tetravalent uranium to the more soluble hexavalent uranium ion. Chlorates and nitric acid are both relatively expensive and have other drawbacks due to their highly corrosive effects on metal valves, piping, etc.

A number of patents have disclosed the employment of sodium carbonate solutions for extracting uranium from underground deposits by a leaching operation. U.S. Pat. No. 2,964,380, issued Dec. 13, 1960 discloses the general concept of a leachant comprising a 3% sodium carbonate solution in water which when applied to crushed uranium ore will leach the uranium therefrom.

U.S. Pat. No. 2,896,930, issued July 28, 1959 states generally that an aqueous solution containing "less than 50 grams per liter of dissolved carbonates" is suitable for underground leaching of uranium ore. An "alkali metal carbonate" is mentioned as suitable for such leaching utility. This patent states generally that "It is advantageous to incorporate an oxidizing agent such as hydrogen peroxide in the leach solution." No specific data or any specific proportions of suitable compositions are given in this patent, other than the above quoted upper limit for unspecified carbonates. At the bottom of column 23, of this patent, it is suggested that the recovery of the uranium whether from the leaching solution or from an inorganic solvent into which it has been incorporated by solvent extraction, may be effected using an ion exchange resin.

Another patent disclosing the use of carbonates is U.S. Pat. No. 2,818,240 issued Dec. 31, 1957. This patent discloses that carbonate solutions comprising 5 to 14% of sodium carbonate, 2% sodium bicarbonate and 5% of sodium chloride form acqueous solutions that would be of a pH of 9.9 to 9.6, but that the sodium chloride reduces the pH to 9.3. This patent also teaches that aqueous solutions of a pH of 9.6 or slightly in excess are effective in leaching out more of the various carbonaceous materials in the ore deposit. The patent also teaches that the sodium bicarbonate depresses the pH, and then it states, "which is undesirable" to secure maximum leading of carbonaceous material as is desired. U.S. Pat. No. 3,708,206, issued Jan. 2, 1973, teaches the pumping of an oxygen bearing gas such as air into a uranium ore body in order to oxidize the uranium to the hexavalent state, and after many hours or days of exposure to the oxidizing gas, a leach solution of sodium carbonate or ammonium carbonate is pumped into the oxidized ore body. The patent teaches as desirable leaching solutions, those containing from 23 to 26 grams per liter of ammonium carbonate.

A recently issued U.S. Pat. No. 3,792,903 teaches the recovery of uranium from underground ore bodies by introducing leachants comprising sodium carbonate and an oxidant which latter may comprise air, oxygen or hydrogen peroxide. No specific solution compositions are given except that the patent states that the sodium carbonate leaching solution to the oxidizing solution may be proportioned from 1:1 to 1:10 by volume.

U.S. Pat. No. 3,130,960 issued Apr. 28, 1964 teaches the use, as a leaching solution, of carbon dioxide gas impregnated water applied to ore deposits of uranium and vanadium. It is noted that such leaching solutions should comprise at least 20% of the maximum possible carbonation in which 100% equals 30 volumes of carbon dioxide per volume of water. These solutions are obviously acidic. Thirty volumes of carbon dioxide in one volume of water provides approximately 59 grams per liter of carbon dioxide, while 20% carbonation introduces about 12 grams of carbon dioxide per liter. This last patent also teaches that the leach solution, after it has passed through the ore body and brought to the surface, is treated with lime to precipitate the uranium and vanadium values.

From the above, it will be apparent that the leaching solutions have generally been relatively concentrated and have comprised either acids or alkali metal carbonates. U.S. Pat. No. 2,818,240 is the only patent that employs a bicarbonate, namely sodium bicarbonate, in a leaching solution. None of the references teaches the use of ammonium bicarbonate and none suggests employing dilute ammonium bicarbonate solutions, alone, or with a peroxide, for leaching uranium values from ore deposits.

The following articles, comprising papers presented at Geneva, Switzerland from Sept. 1 to Sept. 13, 1958 as part of the "Proceedings of the Second United Nations International Conference on the Peaceful Uses of Atomic Energy," published in Volume 3, "Processing of Raw Materials," are of interest with respect to the present invention:

1. "The Role of Process Development in Western United States Uranium Procurement" by J. W. Barnes—pages 183 to 190;
2. "Some Variations of Uranium-Ore Treatment Procedures" by E. A. Brown et al—pages 195 to 200;
3. "Kinetics of the Dissolution of Uranium Dioxide in Carbonate"—Bicarbonate solutions by W. E. Schortmann and M. A. DeSesa, pages 333 to 344; and
4. "Extraction of Uranium from Solutions of Sodium Carbonate by Means of Anionic Exchange with Dowex Resin" by M. Urgell et al; pages 444 to 464.

However, none of this latter art discloses use of dilute ammonium bicarbonate and peroxide leaching solutions for recovering of uranium.

SUMMARY OF THE INVENTION

The present invention relates to an improved method for recovery of uranium from underground ore deposits utilizing in situ leaching by applying thereto relatively dilute slightly alkaline aqueous solutions of ammonium bicarbonate (about 0.5 to 5 grams per liter) containing small amounts of hydrogen peroxide (about 0.1 to 3 grams per liter of $H_2O_2$) in order, first, to convert the tetravalent uranium in the ore deposit to the hexavalent state and, secondly, to dissolve the hexavalent uranium preferentially so that generally a much smaller ratio of vanadium, molybdenum, arsenic, selenium and other metals or elements that may be associated in the ore deposit with the uranium are present in the leach solution. Thereafter, the leaching solution enriched with uranium and relatively poor in other mineral contaminants, is brought to the surface and the uranium is extracted therefrom. Preferably, the extraction of the uranium is accomplished by contacting the enriched leach solution with a strong base anion exchange material, such as a particulate ion exchange resin, and thereafter eluting the uranium from the ion exchange resin with a suitable solution and finally treating the pregnant eluate for instance, first with an acid and then ammonia to precipitate relatively pure ammonium diuranate therefrom.

The leaching solutions employed cause no material deterioration or contamination of the underground deposits or any aquifer associated with the ore deposit. Furthermore, the process produces above the ground surface a very low volume of impurities and waste solution requiring disposal.

Residual soluble uranium values as well as trace elements such as selenium, vanadium and molybdenum, present in the ore body after leaching to an economic level has been effected, are stabilized by introducing, in a final step, a reducing solution into the ore deposit. An aqueous solution with a small concentration hydrogen sulfide, or ammonium thiosulfate, for example, is injected into the well and thence into the ore body so as to precipitate and render insoluble all of those elements in the ore body which become soluble on being oxidized. This ensures that, at the completion of the process, environmental drawbacks are substantially greatly reduced or even eliminated.

The process has proved to be highly efficient so that 80 to 85%, and in some cases as much as 90 to 95% or even more, of the uranium in an ore deposit may be recovered at an economical cost. Equally important is the fact that the process causes a minimum of ecological pollution.

DESCRIPTION OF THE DRAWINGS

For a better understanding of the nature of the invention reference should be had to the following detailed description and drawings, in which.

DETAILED DESCRIPTION OF THE INVENTION

The present invention is adapted to recover uranium from underground ore deposits wherein the uranium is generally in the tetravalent state, and is associated with iron and other minerals or metallic values. Representative of such ore deposits are those that are designated as roll front deposits at and adjacent to a redox interface.

Briefly, geological studies have established the fact that uranium which has been brought to the surface of the earth by volcanic action or the like will dissolve to some degree in surface waters containing oxidizing agents along with carbonic acid. The streams containing the dissolved uranium, along with other metal values, may flow into fluvial sand deposits or, in some cases porous sandstones, which are quite often overlaid and underlaid by mudstone layers of a low permeability. Such sand or sandstone deposits may comprise quartz or silica sands, feldspars and often include carbonate minerals such as calcite and have varying degrees of porosity and/or permeability. The sand or sandstone deposits may include varying amounts of carbonaceous matter such as wood or plant residues, and iron sulfide. Sometimes oil or hydrocarbon gas deposits underly these sandstone and the oil or gas may slowly percolate therethrough. At or in certain areas, hydrogen sulfide which may be present further underground may diffuse or leak into the sandstone deposits to produce a reducing condition while the calcite and feldspar tend to produce a basic condition in the sandstone. When the flowing waters containing uranium and other dissolved minerals enter such sandstone deposits in which reducing and non-acidic conditions are present, the uranium is reduced to the tetravalent state and immediately precipitates within the interstices of the sand or sandstone formation. Vanadium, molybdenum, and selenium as well as other elements are reduced at the same time and also deposit, either concurrently with the uranium or nearby.

Figure 1:
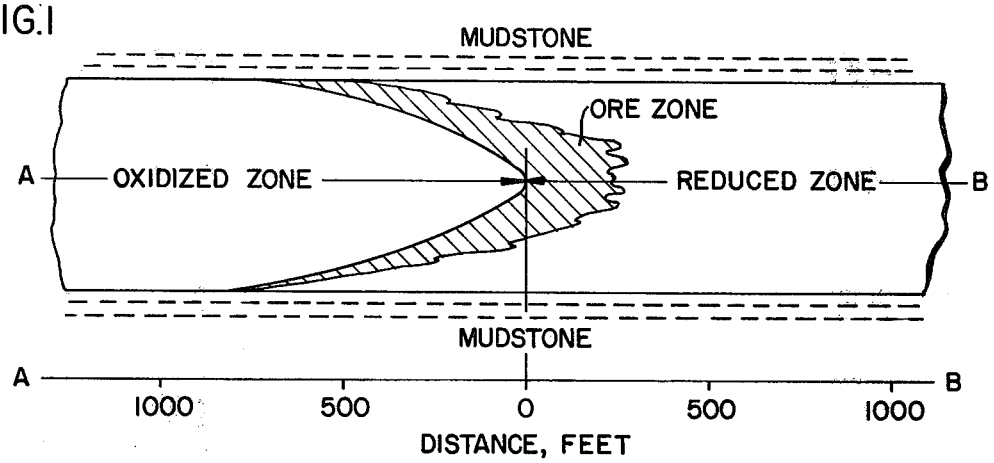
FIG. 1 is a cross section of a roll-front deposit containing uranium and associated elements, at a redox interface.

Referring to FIG. 1, of the drawings, there is illustrated an exemplary cross section through an ore roll deposit showing a bullet shaped redox interface, having a vertical tangential redox interface at the head of the oxidized zone at the center of the Figure. In the area of the redox interface existing between an oxidizing zone through which the waters containing dissolved uranium and other minerals enter from the left and a reducing zone where the waters contact the reducing materials in the sand or sandstone, the uranium precipitates over a period of time to produce a relatively concentrated ore zone in the sand or sandstone interstices. Other minerals in the water stream also precipitate either just before or after the uranium deposits. The mineral depleted waters then traverse to the right along the hydrological gradient through the reduced zone and thereafter disappear from the area. In the oxidized zone at the left in FIG. 1, the sandstone is brown or red colored indicating the presence of precipitated ferric oxide ($Fe_2O_3$ or FeO-(OH)). A relatively sharp interface exists between the oxidized zone and the reducing zone which is evidenced by the abrupt change in color to a light grey or drab color characteristic of the reduced minerals. The usual thickness of the sandstone containing these minerals is of the order of 10 to 50 feet in a vertical direction. The lateral extent of an ore deposit may be hundreds or even thousands of feet. The horizontal distances with respect to the vertical tangential redox interface are typically indicated in FIG. 1. This mineral containing sandstone is usually confined between mudstones or relatively impervious shales.

Figure 2:
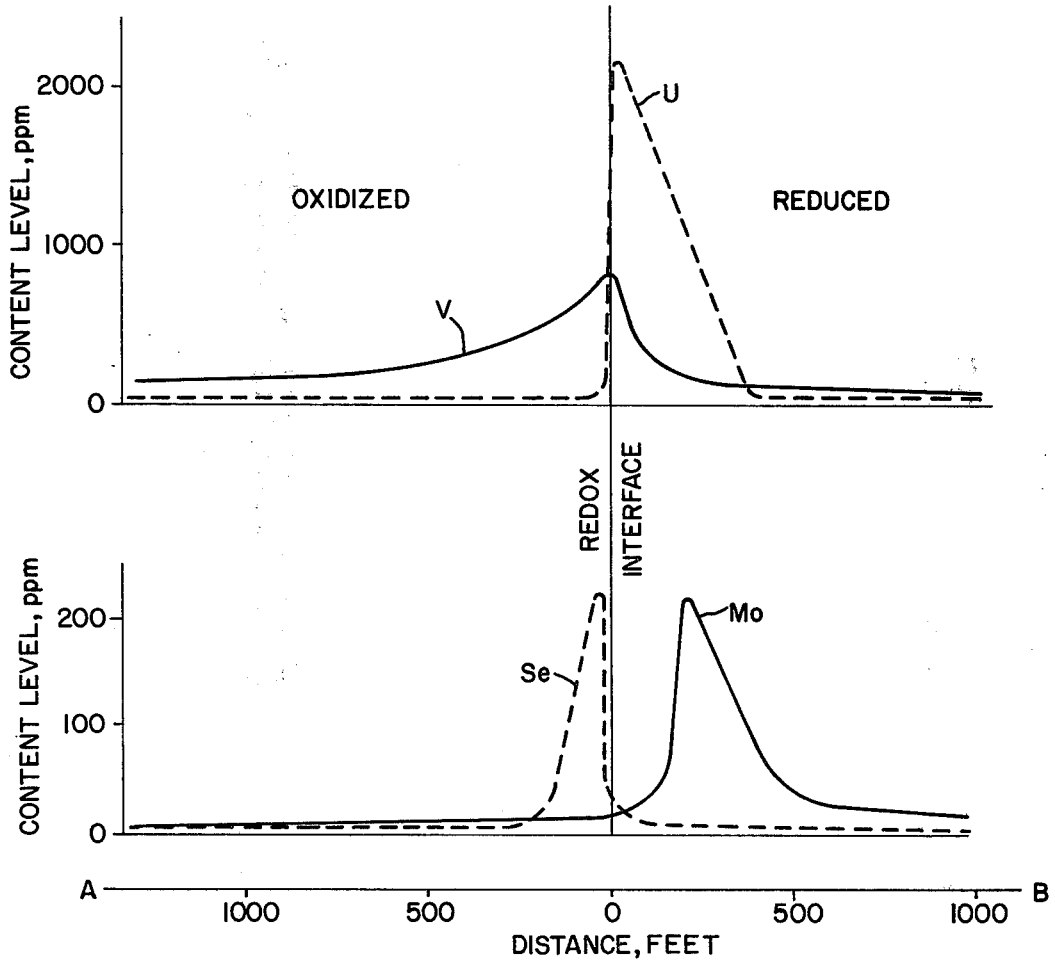
FIG. 2 comprises two vertically separated graphs plotting the level, in parts per million, of a number of commonly associated elements including uranium, in the roll, front deposits with relation to the distance on either side of the redox interface.

It is important to know the general order of deposition of some of the more important elements with respect to the redox interface and these are shown in FIG. 2 for a typical roll front deposit found in Texas. It will be noted that the uranium precipitates almost precisely beginning at the redox interface, with little being present in the oxidized zone, and in the reduced zone the uranium concentration drops steadily so that the uranium deposition is practically all concentrated within roughly the first 500 feet of entry into the reduced zone from the redox interface. In a Texas deposit in the Catahoula formation, the maximum concentration of the uranium is about 2000 ppm at the redox interface and the concentrations drops in a nearly straight line to a 10–20 ppm value at the 400–450 foot point.

As is evident in FIG. 2, the vanadium is more broadly distributed for a considerable distance in the oxidized zone ahead of the redox interface, reaching concentrations of about 800 ppm at the redox interface and then dropping slowly to a lesser concentration extending for some distance into the reduced area. Selenium is practically all precipitated in the oxidized zone in some 200 feet just immediately before the redox interface. Molybdenum, on the other hand, does not appear to be precipitated until the water stream bearing it had passed several hundred feet from the redox interface into areas of strongly reducing conditions. It is also significant that most of the molybdenum is present as molybdenum disulfide. Both selenium and molybdenum reach peak concentrations of about 200 ppm. Ferrous iron is present in greatly varying proportions throughout the area of the reduced zone where the sandstones are generally alkaline in nature having a buffered pH value of about 8.

Due to the presence of substantial amounts of calcite and other alkaline earth carbonates in roll fronts, the use of acidic leaching solutions often is not economically feasible. In many such sandstones the acids will react with the various alkaline earth metal carbonates such as magnesium and calcium carbonates, before they can start dissolving uranium. Consequently, much acid will be lost in ore deposits having substantial amounts of dolomite and limestone.

In accordance with the present invention, it has been discovered that ore deposits having characteristics such as those illustrated in FIGS. 1 and 2 of the drawings may be rapidly and economically leached to recover a high proportion of the uranium in a relatively pure condition and only meagerly contaminated with other elements. In particular, it has been discovered that relatively dilute leach solutions containing from about 0.5 to 5 grams, an optimum being from about 1 to 2 grams, per liter of ammonium bicarbonate $(NH_4)HCO_3$, small proportions of from about 0.1 to 3 grams per liter of hydrogen peroxide ($H_2O_2$) which is preferably added as aqueous hydrogen peroxide of at least 20% concentrated, and preferably 30% to 40% concentrated, with sufficient ammonia to bring it to a pH from about 7.4 to 9 and preferably 7.5 to 8.5, will preferentially dissolve uranium and solubilize a smaller proportion of the iron, vanadium, molybdenum, arsenic, selenium and other elements that may be present in the ore deposit. A greatly improved ratio of uranium to the total of other elemental values is present in the leaching solution as compared to the proportions of uranium to these other elements in the ore deposit. Some elements are dissolved in an extremely small amount as compared to the ratio of these elements to the uranium in the ore deposit. Consequently, immediate beneficiation as respects the recovered uranium occurs.

The pregnant ammonium bicarbonate leach solutions withdrawn from the deposit are moderately enriched with the uranium to the extent of from about 100 to 1000 ppm of uranium. Leach solutions with from 200 to 245 ppm of uranium, computed as $U_3O_8$, have been obtained under steady state leaching conditions.

The leach solutions are withdrawn from the underground ore deposit after they have been delivered thereto via one or more injection wells spaced with respect to one or more withdrawal wells from which withdrawal wells the enriched leaching solution is recovered.

Figure 3:
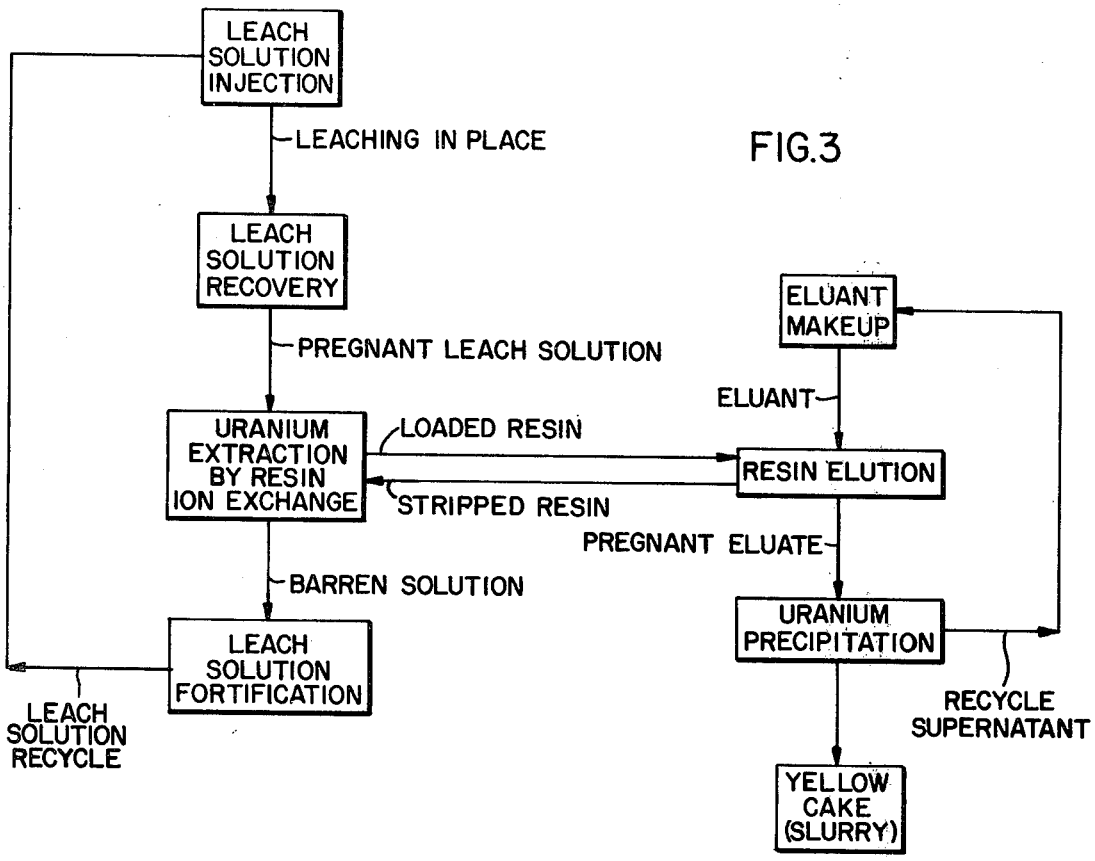
FIG. 3 is an in situ leaching flow sheet of the present invention.

Referring to FIG. 3 of the drawings, there is a flow sheet illustrating the overall general practice of the present invention. The leach injection solution comprises from 0.5 to 5 grams per liter of ammonium bicarbonate and from about 0.1 to 3 grams per liter of hydrogen peroxide, ordinarily added as aqueous hydrogen peroxide, and sufficient ammonia is added to bring the pH of the solution to from about 7.4 to 9. The hydrogen peroxide is preferably added to the leaching solution immediately before it is delivered into the injection well leading to the underground ore deposit in order that the hydrogen peroxide does not decompose prematurely. The hydrogen peroxide could even be added to the leach solution in the well casing, making sure that it is well mixed in before the leach solution enters the ore body. The leach solution in the injection well is usually under a pressure of from 50 to 250 psi. The pressure depends in part on the permeability of the sandstone and in part on the distance of the injection well from one or more withdrawal wells. It should be understood that injection of leach solution may be carried out in one or more injection wells either simultaneously or serially.

It has been found that good results are obtained when the injection wells are preferably disposed about one or more centrally located withdrawal wells which may be spaced to provide a distance of from about 20 to 100 feet between an injection well and the nearest withdrawal well. In some cases the injection well may be located advantageously on the upper side of the natural hydraulic gradient with respect to the withdrawal wells. Carefully located perforations are provided in the well casing to permit leach solution to flow directly only into the ore zone. The leaching solution in passing through the ore body will oxidize the ferrous iron to ferric iron and the tetravalent uranium present is converted to the hexavalent state. The ammonium bicarbonate in the leach solution reacts with and readily dissolves the hexavalent uranium in the form of uranyl dicarbonate complex. Very little iron dissolves in the leach solution. As the leaching solution contacts the uranium in the sandstone and oxidizes and then dissolves the resulting hexavalent uranium, it exposes any previously shielded or underlying tetravalent uranium which in turn is oxidized and then dissolved. After passing through the sandstone or other formation the enriched leach solution passes through perforations into the recovery or withdrawal well or wells. Usually a pump will be placed in the bottom of the recovery well and the water head in the recovery well is maintained at a low level in the well so that there is a low hydraulic pressure in the formation adjacent the withdrawal well. Consequently, a hydraulic gradient extends from the injection well to the withdrawal well thereby causing the leach solution to flow or percolate through the sandstone formation toward the withdrawal well. If desired, the withdrawal well may be capped and a pump at the bottom energized to draw a vacuum with respect to the surrounding ore deposit so that leach solution is drawn more strongly to the withdrawal well.

Tests have indicated that the dilute ammonium bicarbonate solution dissolves hexavalent uranium in substantial preference to the other mineral values which are also soluble in this leach solution. Thus, assuming an arbitrary ratio of the uranium to the other elements in the ore deposit as 1000 to 100, in the enriched leach solution the ratio of the uranium to the other elements may be of the order of 1000 to 5 to 10. Thus, a roughly 10 to 20 fold improvement in the proportion of the recovered uranium with respect to the other elements is obtained by use of the dilute alkaline ammonium bicarbonate leach solution.

Thus, in one case, where the ore body had 1269 ppm U (calculated as $U_3O_8$), vanadium 106 ppm, arsenic 12 ppm, molybdenum 8 ppm and selenium 3 ppm, the ratio of uranium to vanadium was 12, the ratio of uranium to arsenic was 106, the ratio of uranium to selenium was 403 and uranium to molybdenum was 159. After passing an aqueous leaching solution containing 0.95 gr. per liter of ammonium bicarbonate and 2.2 grams per liter of hydrogen peroxide, the solution exhibited a uranium to molybdenum ratio of 6800, a uranium to arsenic ratio of 5667, a uranium to selenium ratio of 531 and a uranium to molybdenum ratio of 59. A later test of the leach solution from this well showed that it now had a uranium to molybdenum ratio of 259, while the uranium to selenium ratio was 15,436. Very little iron is found in the leach solution. Consequently, the selectivity of the leach solutions of this invention for uranium as compared to other elements is excellent.

As shown in FIG. 3, the enriched leach solution pumped from the withdrawal well is then passed to an ion exchange column comprising a strong base anion material such as a granular resin ion exchange material. In the ion exchange column, the uranium is preferentially extracted from the enriched leach solution with only a small proportion of the other elements being extracted. The ion exchange material is caused to progress countercurrently to the flow of leach solution so that the solution coming directly from the withdrawal well contacts ion exchange material which has picked up uranium from an earlier flow of leach solution, and as the leach solution traverses the column of the iron exchange material it meets ion exchange material which has absorbed less and less uranium and accordingly it will extract more and more of the uranium therefrom, until nearly depleted leach solution contacts relatively fresh ion exchange material thereby effecting the maximum uranium recovery.

The basic anion exchange material, for example, a 16 to 20 mesh ion exchange resin such as tertiary amine reacted chloromethyl-styrene-divinyl benzene resin (as described in Chemical Engineering for Mar. 18, 1963 on pages 166 and 167), when it has taken up nearly its maximum amount of uranium is removed in increments from the bottom of the ion exchange column and treated with an eluting solution. An aqueous eluant is applied to the so-removed uranium charged basic anion exchange material to strip therefrom the uranium as ammonium uranyl dicarbonate and the stripped and rejuvenated ion exchange resin is then returned to the top of the ion exchange column to recover additional uranium. The concentration of uranium in the eluate produced by treatment of the basic anion exchange material may be from 5 to 18 grams per liter of uranium, computed as $U_3O_8$. A number of different continuous counter-current ion-exchange contactors and eluant recovery systems may be employed. Examples of suitable systems are taught in the Jan. 1969 issue of "British Chemical Engineering," pages 41 to 46 in an article by M. J. Slater entitled "A Review of Continuous Counter-Current Contactors for Liquids and Particulate Solids."

The uraniferous aqueous eluate is acidified and then ammonia is added to bring it to a pH of about 7 to 8 to precipitate ammonium diuranate (ADU) of a high purity. Ordinarily, the purity of the ADU precipitate after washing is such that the impurities therein will not exceed about 1%.

The barren leach solution ordinarily contains dissolved calcium salts. It is desirable to remove these calcium ions prior to refortification of the leach solution. To accomplish this, the barren leach solution is passed through an ion exchange where ammonium is substituted for calcium. The treated barren leach solution is then adjusted or fortified with additional ammonium bicarbonate, ammonia and hydrogen peroxide and reinjected into the ore deposit to extract additional uranium therefrom.

The ammonium bicarbonate for the leach solution may be prepared by adding ammonium bicarbonate to the aqueous leaching solution. However, a convenient and, probably the least expensive way of producing the leach solution, is by simply passing ammonia and carbon dioxide gases in the required proportions directly into the water where they react in situ into ammonium bicarbonate. At the same time, a slight excess of ammonia is added to bring the pH to the desired value of about 7.4 to 9. Particularly good results are had when the pH of the leach solution is about 7.7 to 8.5. The following Table of equations comprise the basic reactions of the process.

Consequently, from time to time when the flow of the leach solution has diminished appreciably due to such plugging, each injection well may be treated by passing therethrough an acid, for example from 10 to 100 gallons of acetic acid. The acid dissolves any calcite or other reactive plugging materials so that free flow of the leaching solution can again take place.

Since only ammonium bicarbonate and hydrogen peroxide, and dilute concentrations at that, are injected into the underground deposit there are no significant undesirable ion impurities introduced into the ore deposit well. The ammonia is readily adsorbed by the clay mineral within or forming the strata which usually underlie and overlie the ore deposit. It will be understood that only small concentrations of ammonia are introduced into the ore deposit in any event. Consequently, only small quantities of ammonium bicarbonate or free ammonia will be present in any unit volume of the ore deposit. The hydrogen peroxide reacts promptly underground, oxidizing the ferrous iron and tetravalent uranium, so that no free peroxide exists after the leach

TABLE PROCESS CHEMISTRY

| | | |
|---|---|---|
| Leaching | $UO_2$(mineral) + $H_2O_2$ | |
| | ↓ | |
| | $UO_3$(oxidized mineral) + $H_2O$ | |
| | + | |
| | $NH_4HCO_3$ excess | |
| | ↓ | |
| | $(NH_4)_2UO_2(CO_3)_2$ + $NH_4HCO_3$ excess + $H_2O$ | Pregnant leach solution |
| Uranium Extraction by Resin Ion Exchange | $(NH_4)_2UO_2(CO_3)_2$ + $NH_4HCO_3$ excess | Pregnant Leach Solution |
| | + | |
| | RCl (resin chloride) | |
| | ↓ | |
| | $R_2UO_2(CO_3)_2 . R_2CO_3 . RHCO_3 . RCl$ | Loaded resin |
| | ↓ | |
| | $NH_4Cl$ + . $NH_4HCO_3$ excess | Barren leach solution for recycle |
| Resin Elution | $R_2UO_2(CO_3)_2 . R_2CO_3 . RHCO_3 . RCI$ | Loaded resin |
| | + | |
| | $NH_4Cl$ + $NH_4HCO_3$ | Eluant |
| | ↓ | |
| | RCl | Stripped resin |
| | ↓ | |
| | $(NH_4)_2UO_2(CO_3)_2$ + $NH_4Cl$ + $NH_4HCO_3$ | Pregnant eluate |
| Acidification | $(NH_4)_2UO_2(CO_3)_2$ + $NH_4Cl$ + $NH_4HCO_3$ | Pregnant eluate |
| | + | |
| | $H_2SO_4$ | |
| | ↓ | |
| | $UO_2SO_4$ + $CO_2$ ↑ + $H_2O$ + $NH_4Cl$ + | |
| | $(NH_4)_2SO_4$ + $H_2SO_4$ slight excess | |
| Precipitation | $UO_2SO_4$ + $NH_4Cl$ + $(NH_4)_2SO_4$ + $H_2SO_4$ slight excess | Acidified eluate |
| | + | |
| | ↓ | |
| | $NH_3$ | |
| | $(NH_4)_2U_2O_7$ (solid) (ADU) + $(NH_4)_2SO_4$ = $NH_4Cl$ | Uranium (ADU) precipitate slurry |

The enriched leach solution recovered from the ore deposit may contain small amounts of fine suspended calcite and clay particles. It is desirable to treat the barren leach solution to remove calcium by filtering the leach solution prior to reinejcting it into the well.

It has been found that occasional plugging of the ore deposit may occur in areas adjacent the injection well.

solutions have passed through a distance into the ore deposit.

While hydrogen peroxide is available in concentrated solutions of up to 100%, such high strength solutions are hazardous to handle, in addition to being quite costly. Commercially available concentrations of aqueous hydrogen peroxide found to be useful in the practice of the present invention are those of at least 20% $H_2O_2$ concentration and preferably from about 30% to 40% hydrogen peroxide.

The following examples are illustrative of the practice of the present invention.

A series of field tests were conducted which make clear the importance of adding the $H_2O_2$ to the leach solution at a point as close to the well as is reasonably possible so that the peroxide reaches the ore deposit in the shortest time without decomposing before it has a chance to oxidize the mineral.

| Test No. | Point of Peroxide Introduction | Peroxide g/l | Ratio $H_2O_2$/ $U_3O_8$ | Recovered Leach Solution Max. $U_3O_8$ Recovery-ppm |
|---|---|---|---|---|
| 2A10 | Tank | 0.5 | 15 | 35 |
| 2A11 | Tank | 1.0 | 11 | 89 |
| 2A15 | Injection Line | 0.58 | 3 | 196 |
| 2A16 | Injection Line | 0.91 | 4 | 227 |

The "tank" was a 3000 gallon tank holding water to which the ammonium carbonate was added as well as the hydrogen peroxide, if it were added there, and stirred to produce the leach solution. The solution so prepared was then injected into the well at rates of up to about 5 gallons per minute. The term "Injection line" indicates that the peroxide was injected into the aqueous ammonium carbonate leach solution in the pipe just before it entered the injection well. It is obvious from the data that the most economical use of the peroxide enabling more uranium to be dissolved in the leach solution occurred when the peroxide was added to the leaching solution just as it was being pumped into the well. Premature decomposition of the peroxide undoubtedly had occurred in the tank when it was introduced there.

A twenty six day run was made using a series of wells in a uranium bearing Catahoula geological formation at Bruni, Texas. The ore deposit averaged 11 feet thick over the area being leached, and the $U_3O_8$ content therein varied from 0.259% to 0.026% by weight. The well system comprised seven injection wells disposed circumferentially about the surrounding three recovery wells all to a depth of from about 140 to 200 feet. For each 24 hour period from 33,000 to 46,000 gallons of leach solution would be injected into the formation and roughly the same amount of enriched leach solution was pumped out. In the 26 day period, a total of 1,038,800 gallons of solution was injected and 1,033,560 gallons was recovered. From the recovered leach solution a net of 1019 pounds of $U_3O_8$ was recovered during this period.

For the first eight days the bicarbonate, ammonia and $H_2O_2$ was maintained at very low levels as follows:

| $HCO_3^-$ gr/l | $NH_4^{\pm}$ gr/l | $H_2O_2^-$ gr/l |
|---|---|---|
| 0.25 to 0.42 | 0.014 to 0.104 | 1.07 and less |

During this 8 day period, the uranium recovery per day ran from 6.3 lbs. to 13.8 lbs. of $U_3O_8$. The bicarbonate and ammonia concentrations were obviously too low to be effective in securing good uranium recovery. In addition the uranium concentration in the leach solution was low.

From the 9th day to the 13th day the bicarbonate and ammonia content of the leach solution was increased materially: the bicarbonate varied from 0.60 to 0.72 gr/l, and the $NH_4^+$ varied from 0.202 to 0.44 gr/l. Since about a day elapses from the date of injection of a changed leach solution to its recovery, the uranium recovery on the 9th day was 16.3 lbs., then it increased to 21.8, 23.6, 35.3 and 36.6 lbs. of $U_3O_8$ on the 10th to 13th days respectively. By roughly doubling the ammonium carbonate concentration in the leach solution over that used in the first 8 day runs, the uranium recovery ran from about 3 to 5 times greater.

From the 14th day to the end of the run, the leach solution was prepared to carry a greater concentration of bicarbonate and substantially more ammonia was also added, so that the bicarbonate content was in the range of from 0.80 to 1.15 gr/l, and the $NH_4^+$ content was in the range of from 0.54 to 0.855 gr/l. The uranium recovered during each of the 14th to 26th days ranged from 46.2 lbs. to 83.9 lbs. $U_3O_8$ per day.

The $H_2O_2$ content of the leach solution for the last 20 days of the run varied from 0.41 to 1.03 gr/l. The pH of the leach solution throughout the 26 day ran from 7.5 to 8.1.

It will be appreciated that the leach solutions used during the run were extremely dilute by comparison to prior art practices which normally used from about 20 to 25 grams per liter of carbonates. As far as is known, no one in this art had successfully used, if at all, solutions of such dilution with such surprisingly good results as secured here.

The ammonium diuranate recovered from the leach solutions during this 26 day run was a bright yellow product of excellent high purity.

The 26 day run extracted some 25% of the uranium in the deposit. Two earlier trial runs had extracted some 15% of the uranium in the ore deposit. The recovery of 73.3 lbs. of $U_3O_8$ on the last day of the run indicated that it was still producing strongly and would continue to do so for many more days.

These uranium leaching runs in this ore deposit were terminated after some 75% of the uranium was recovered from the area within the effective ambit of the injection wells. The passage of an aqueous reducing solution through the formation would render insoluble the uranium, selenium, molybdenum, arsenic and vanadium so that these elements would not dissolve in water and contaminate any aquifer.

Other tests indicated that exceeding about 5 grams per liter of ammonium bicarbonate and 3 grams per liter of peroxide did not give any appreciable increase in the uranium content of the leach solution. All of the peroxide was consumed without any noticeable benefit.

Figure 4:
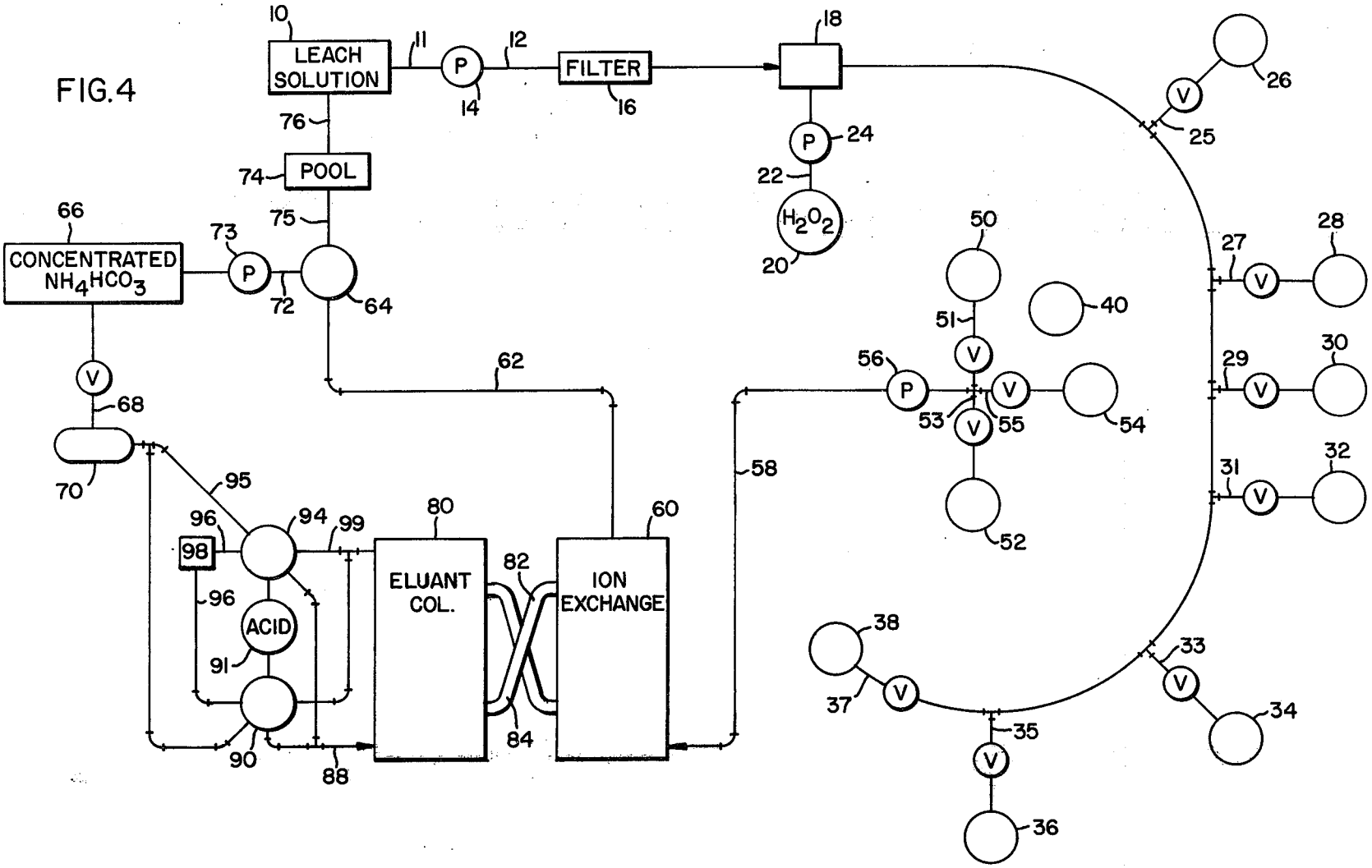
FIG. 4 is a plan view of the apparatus handling and distributing various solutions and the associated equipment along with a well arrangement applied to an exemplary underground ore deposit, comprising an in situ leaching and uranium recovery system.

Referring to FIG. 4, there is schematically illustrated apparatus and wells associated therewith found to be suitable for practicing the invention. Leach solution comprising from about 0.5 to 5 grams per liter of ammonium bicarbonate is contained in a tank 10, from which it flows through a pipe 11 to a pump 14 which pumps it at a pressure of from about 50 to 250 psi into a line 12 leading to one or more injection wells. The leach solution under pressure is conveyed by line 12 to a filter 16 where any fine clay, calcite and other solid particles are filtered out, and thence to a hydrogen peroxide injector 18. Aqueous hydrogen peroxide, for example, 30% $H_2O_2$, in a storage tank 20 passes by pipe 22 to a pump 24 which pressurizes it into the injector unit 18 where measured proportions of the hydrogen peroxide are injected into the leach solution at a rate to provide from about 0.1 to 3 grams of $H_2O_2$ per liter of leach solution. The pipe 12 is connected to each of the injector wells 26, 30, 32, 34, 36 and 38 by branch conduits 25, 27, 29, 31, 33, 35 and 37, respectively, each of the latter having valves therein to enable control of flow of the pressurized leach solution into one or more wells at any selected time or sequence.

As is known in the art, the wells comprise a casing which penetrates into or through at least one uranium bearing ore stratum. Perforations and/or screens are present in the portions of the well casing disposed in the uranium bearing stratum to permit pressurized leach solutions to penetrate into through the uranium bearing ore. Normally efforts are made to minimize passage of the leach solution to any other stratum by employing suitable sealing means between the casing and the well bore. The uranium bearing ore stratum, such as the roll front deposits described above comprise sandstone, sand or other permeable formations through which the leach solution passes readily. The ore bearing formation is usually characterized by the presence of an underlying less fluid pervious shale or clay layer, and a cap layer of shale, mudstone, or clay so that the leach solution flows laterally from the well tubing perforations into the uranium ore body with very little vertical flow into formations containing little or no uranium. The leach solution spreads laterally from the injection wells, following the hydraulic gradient, and any channels or fissures in the ore body. The hydrogen peroxide in the leach solution in contacting ferrous iron in the ore will convert it into ferric iron and any tetravalent uranium is also converted to hexavalent uranium which last is readily dissolved by the ammonium bicarbonate leach solution. If the uranium is present as a modular mass or body of appreciable size, the uranium is progressively converted from the exterior surface inwardly, to the hexavalent state and dissolved as successive quantities of leach solution pass and come into contact with it. It appears that while much of the iron is converted to the ferric state, very little is dissolved in the leach solution, so that nearly all the iron remains underground. Similarly, only small amounts of molybdenum, vanadium, arsenic and selenium are dissolved in the relatively dilute leach solution. By comparison, a high proportion of the uranium in the ore deposit affected is dissolved with the passage of sufficient leach solution through the ore body.

A monitor well 40 was also drilled in order to enable pH, hydrostatic pressure, temperature, solution density and other factors to be determined by disposing suitable instruments therein.

In order to withdraw the pregnant leach solution rich in uranium, one or more withdrawal wells are disposed in a spaced configuration with respect to the adjacent injection wells. A suitable configuration used with success is to dispose an encircling array of injection wells about a smaller number of withdrawal wells. For example, in one case, seven injection wells were spaced to surround three withdrawal wells.

If there is a strong hydraulic gradient and elongated fissures or the like in one direction, the withdrawal wells will be placed so that they are at the lower end of the hydraulic gradient in order that the leach solution will naturally flow in their direction and be intercepted.

Disposed within withdrawal wells 50, 52 and 54 are valved connecting conduits 51, 53 and 55 respectively, connected by a pump 56 to a pipe 58 for carrying pregnant solution to a uranium recovery system. While pump 56 is shown external of the wells, a separate submerged pump disposed in each well has been used in each well with good results. Ordinarily, an end of each conduit 51, 53 and 55 is disposed at the lower end of the well with which it is associated. The withdrawal well comrises a casing with a perforated portion with suitable screens to permit leach soluton to flow into it without allowing sand and other solids to come through. The pump 56 can be operated to keep the leach solution at any selected level in the well so as to maintain a desired hydraulic head therein so that flow of leach solution therein is established and controlled. Each well can be capped and a vacuum applied by operation of the pump 56 so that leach solution is attracted more strongly to the withdrawal well. In operation of the well system of this invention, it will be noted in the previous example, only some 5000 gallons out of a total of 1,038,800 gallons was not recovered. Some of this 5000 gallon difference might be due to inaccuracy in flow measurements as well as losses underground and above ground.

Pregnant leach solution is transported by pipe 58 to an extraction column 60 where it is introduced at the bottom of a bed of 12 to 20 mesh strong base anion exchange resin which strips the uranium therefrom with very little of such dissolved impurities as, for example, molybdenum, vanadium, selenium and iron.

The depleted or barren leach solution is passed from the top of the column 60 by a pipe 62 to a make-up tank 64. Water may also be introduced into the tank 64 to replace unrecovered solution. Concentrated ammonium bicarbonate in a tank 66 is treated with sufficient ammonia ($NH_3$) from a tank 70 via a valved line 68, and the ammoniated ammonium bicarbonate is added via pipe 72 to the leach solution in tank 64 at a controlled rate by operation of a pump 73, so as to bring the ammonium bicarbonate in the leach solution to the proportions of about 0.5 to 5 grams per liter. The adjusted leach solution is conveyed to a pool reservoir 74 by a pipe 75 from whence it is conveyed by a pipe 76 to the original tank 10. It will be understood that two or more make-up tanks 64 may be alternately filled with barren leach solution, and then sufficient ammonia and ammonium bicarbonate added to bring the solution to full leach strength and then dumped into pool 10, while the other make-up tank is being filled from pipe 62.

The uranium loaded base ion exchange resin in column 10 is preferably caused to be removed, either continuously or in increments, from the bottom of column 10, and transferred by a line 82 to an elution column 80 where it is treated with strong aqueous solution of ammonium chloride, for example 1.5 molar, and a small amount of ammonium bicarbonate, about 0.1 molar, entering through pipe 86. The uranium is thus extracted from the ion exchange resin to provide a uranium rich eluate. The stripped and regenerated ion exchange resin is returned by line 84 to the top of column 60 where it descends and progressively strips uranium from the leach solution passing upwardly.

The eluate with a high content of uranium, for instance, from 10 to 20 grams per liter, is carried by pipe 88 from column 80 to either one of two ammonium diuranate (ADU) precipitating tanks 90 and 94. When one of the tanks 90 or 94 is filled with the eluate, the eluate is then conveyed to the other tank. Into the eluate filled tank 90 or 94, a measured amount of acid from a supply tank 91 containing HCl, for example, is added to the eluate, with suitable agitation and stirring. Then ammonia is added from supply tank 70 via pipe 95 to cause the solution to reach a pH of about 7, whereupon ADU precipitates. Upon letting the ADU precipitate settle, the supernatant liquid is reconveyed by conduit 99 to the elutant tower 80, while the ADU slurry at the bottom is pumped to an ADU storage reservoir 98 through conduit 96. The final ADU product contains only small amounts of residual impurities.

While the leaching process described herein has proven to give good results when applied to uranium containing roll front ore deposits and particularly where a redox interface is present, the process can be applied to other types of ore deposits wherein the ore body is sufficiently permeable to permit adequate flow of the leach solution into contact with uranium which it can convert into the hexavalent state end then dissolve it, and the uranium enriched leach solution can be recovered.

We claim as our invention:

1. In the process of in situ leaching of uranium from ore deposits, the steps comprising:

(a) passing through the ore deposit an aqueous leach solution of a pH of from about 7.4 to 9 comprising from about 0.5 to 5 grams per liter of ammonium bicarbonate and from about 0.1 to 3 grams per liter of $H_2O_2$, the peroxide being added at a point to prevent substantial decomposition thereof before it comes into contact with the ore, (b) withdrawing from the ore deposit the enriched aqueous leach solution after it has been in contact with uranium of the ore deposit and dissolves uranium, and (c) stripping the uranium from the enriched aqueous leach soluton.

2. The process of claim 1, wherein the peroxide is provided by an aqueous hydrogen peroxide soluton of at least 20% concentration of $H_2O_2$, wherein ammonia is added to the leach solution to provide a pH of from about 7.5 to 8.5 in the leach solution, and wherein the ammonium bicarbonate is from about 1 to 2 grams per liter and wherein the point of addition of the peroxide is just before it comes into contact with the ore.

3. The process of claim 1, wherein the step of stripping comprises contacting the uranium enriched aqueous leach solution with a strong base anion exchange material to cause the uranium to be retained on the base anion material, separating the stripped leach solution from the base anion material, eluting the uranium from the base anion exchange material with an aqueous eluant and finally treating the eluate with an acid and then with ammonia to precipitate relatively pure ammonium diuranate.

4. The process of claim 3 wherein the stripped leach solution is adjusted by adding sufficient ammonium bicarbonate and peroxide to bring it to its original condition.

5. The process of claim 4 wherein the stripped leach solution is subjected to ion exchange treatment to replace any calcium in the solution with ammonium before adding the ammonium bicarbonate.

6. In the process of in situ preferential leaching of uranium from a redox interface roll front ore deposit which contains certain proportions of other metals and elements, the steps comprising:

(a) injecting into the ore deposit at or adjacent to the redox interface an aqueous leach solution comprising essentially from about 1 to 5 grams per liter of ammomium bicarbonate, from about 0.1 to 3 grams per liter of hydrogen peroxide and sufficient ammonia to bring the solution to a pH of from about 7.4 to 8.5, (b) withdrawing from the ore deposit the enriched aqueous leach solution after it has been in contact with the uranium of the ore deposit, the proportion of the uranium to the total of said other metals and elements in the enriched leach solution being higher than in the ore body, (c) contacting the enriched leach solution with a base anion exchange material to cause the uranium to be extracted from the enriched leach solution, and retained by the anion exchange material, (d) separating the uranium loaded base anion exchange material from the stripped leach solution, (e) adjusting the ammonium bicarbonate, peroxide and pH of the separated stripped leach solution to the original range and recirculating the adjusted leach soluton into the ore deposit to dissolve more uranium, (f) applying an alkaline aqueous eluant solution to the uranium loaded base anion exchange material to extract and dissolve the uranium therefrom and separating the pregnant uraniferous eluate from the depleted anion exchange material, and (g) acidifying the pregnant uraniferous eluate and then introducing ammonia to precipitate relatively pure ammonium diuranate, the steps providing progressively richer uranium solutions with a progressively lower proportion of other elements and metals in successive stages.

7. The process of claim 6 in which the ore deposit contains both ferrous iron and tetravalent uranium in the vicinity of the redox interface, and the peroxide in the leach solution converts at least a portion of the ferrous iron to ferric iron and the tetravalent uranium to hexavalent uranium, which hexavalent uranium then readily dissolves in the ammonium bicarbonate leach solution.

8. In the process of in situ preferential leaching of uranium at or adjacent to a redox interface of a roll front ore deposit which contains ferrous iron and other metals and elements as well as relatively water insoluble tetravalent uranium in certain proportions, the steps comprising:

(a) injecting under pressure through at least one injection well into the ore deposit an aqueous leach solution comprising essentially from about 1 to 5 grams per liter of ammonium bicarbonate, from about 0.1 to 3 grams per liter of hydrogen peroxide, and sufficient ammonia to bring the leach solution to a pH of from about 7.5 to 9, to cause the leach solution to traverse the ore deposit and convert the ferrous iron to ferric iron and the uranium to hexavalent uranium which is soluble in the leach solution as it traverses the ore deposit, (b) withdrawing from at least one withdrawal well adjacent to an injection well, enriched leach solution which has passed through the ore deposit and dissolved uranium which has been converted to the hexavalent state, the leach solution having dissolved therein uranium and some of the said other metals and elements in proportions such that the uranium is present in a much greater ratio with respect to the total of such other elements than in the ore deposit, and (c) stripping the uranium from the enriched leach solution.

9. The process of claim 8 wherein the hydrogen peroxide is added to the leach solution as close to the time when it contacts the ore deposit as is reasonably possible so that a high proportion of the hydrogen peroxide is effective in oxidizing the tetravalent uranium in the ore deposit.

10. The process of claim 8, wherein the stripping of the uranium from the enriched leach solution comprises contacting the enriched aqueous leach solution with a base anion exchange material to cause the uranium to be retained on the base anion material, separating the stripped leach solution from the base anion material, eluting the uranium from the base anion exchange material with an alkaline aqueous eluant and finally treating the pregnant eluate with an acid and then treating it with ammonia to precipitate relatively pure ammonium diuranate.

11. The process of claim 8 wherein the hydrogen peroxide added to the leach solution comprises from about 0.3 to 2 grams per liter of $H_2O_2$, introduced as aqueous 30% to 40% hydrogen peroxide solution.

12. The process of claim 8 wherein after injection of the aqueous leach solution into said well for a period of time there occurs an increased resistance to passage of the leach solution into the ore deposit due to plugging of the deposit, the injection of leach solution is halted and a quantity of acid is injected into the well to dissolve the plugging, and thereafter the injection of the leach solution is resumed.

13. The process of claim 8, wherein after the recovery of uranium by the process is terminated, there is passed into the ore deposit an aqueous reducing solution to convert the uranium and other elements to a less soluble state whereby they precipitate and are relatively insoluble in ordinary underground waters.

14. In the process of recovering uranium from an ore body wherein the uranium may be associated with various other metals and elements, by introducing a leach solution comprising an alkaline material and an oxidizing agent which converts the uranium to the hexavalent state and also renders some of the metals and elements soluble in aqueous solutions, the improvement comprising the step of concluding the leaching of the uranium from the ore body by introducing a reducing leach solution into the ore body so as to cause the uranium, and various other metals and other elements to become insoluble and precipitate.

* * * * *